US007108102B2

(12) United States Patent
Woodward

(10) Patent No.: US 7,108,102 B2
(45) Date of Patent: Sep. 19, 2006

(54) PROTECTIVE DEVICE FOR LADDERS

(76) Inventor: Patricia A. Woodward, 2 Island Rd., Groton, MA (US) 01450

( * ) Notice: Subject to any disclaimer, the term of this patent is extended or adjusted under 35 U.S.C. 154(b) by 0 days.

(21) Appl. No.: 10/750,147

(22) Filed: Dec. 31, 2003

(65) Prior Publication Data

US 2004/0154865 A1 Aug. 12, 2004

Related U.S. Application Data

(60) Provisional application No. 60/437,613, filed on Jan. 2, 2003.

(51) Int. Cl.
*E04G 5/02* (2006.01)
*E06C 7/42* (2006.01)

(52) U.S. Cl. ..... 182/108; 182/107

(58) Field of Classification Search ..... 182/108, 182/107, 109, 214, 129
See application file for complete search history.

(56) References Cited

U.S. PATENT DOCUMENTS 2,904,128 A * 9/1959 Boham et al. ..... 182/108
3,662,856 A 5/1972 D'Amico et al.
3,993,163 A 11/1976 Barrett
4,498,579 A * 2/1985 Brick ..... 206/315.4
4,726,446 A 2/1988 Perbix
4,771,862 A 9/1988 Garland
4,899,848 A 2/1990 Parr
5,533,591 A * 7/1996 Kiska ..... 182/108
5,638,915 A * 6/1997 Hardy ..... 182/129
5,647,453 A * 7/1997 Cassells ..... 182/129
5,749,437 A * 5/1998 Weller ..... 182/129
6,435,304 B1 * 8/2002 Stierle ..... 182/129
6,499,563 B1 * 12/2002 Bremick ..... 182/108
6,594,836 B1 * 7/2003 Everson et al. ..... 5/485

* cited by examiner

*Primary Examiner*—Hugh B. Thompson, II
(74) *Attorney, Agent, or Firm*—Butzel Long

(57) ABSTRACT

A protective device releasably mounted to an upper end portion of a ladder for protecting a surface on which the ladder rests includes a flexible body formed of a fabric material and having a bag-like shape with an opening formed therein receiving the upper end of the ladder and an associated ladder cover. An elastic band attached to the body extends at least partially about the opening to reduce a size of said opening and is attached to the body by stitching.

15 Claims, 2 Drawing Sheets

PROTECTIVE DEVICE FOR LADDERS

CROSS-REFERENCE TO RELATED APPLICATION

This application claims the benefit of U.S. provisional patent application Ser. No. 60/437,613 filed Jan. 2, 2003.

BACKGROUND OF THE INVENTION

The present invention relates generally to protective covers for ladders.

The following patents provide background in the field of protective devices for ladders:

The U.S. Pat. No. 3,662,856 entitled "Easy Ladder Safety Protector" shows a flexible foam body formed of a plurality of resilient gas filled cells and having a receptacle for receiving the end of a ladder side rail.

The U.S. Pat. No. 3,993,163 entitled "Ladder Socks" shows a pad of resilient polyurethane foam that is wrapped about the upper end of a ladder side rail and secured by a strap.

The U.S. Pat. No. 4,726,446 entitled "Protection Cover for Ladder" show an inverted box-shape vinyl plastic cover that extends over and between the upper ends of a pair of ladder side rails.

The U.S. Pat. No. 4,771,862 entitled "Ladder Guards" shows a cup-shaped member made of soft rubber-like plastic that fits over the upper end of a ladder side rail.

The U.S. Pat. No. 4,899,848 entitled "Guard for Upper End of Ladder Side Rail" shows a rigid body that fits over the upper end of a ladder side rail and a replaceable resilient pad attached to the body.

SUMMARY OF THE INVENTION

The present invention concerns a protective device adapted to be releasably mounted to an upper end portion of a ladder enclosed in an associated ladder cover. The protective device includes a flexible body formed of a fabric material, such a terry cloth, and having a bag-like shape with an opening formed therein, the body being sized to cover the upper end of the ladder and the ladder cover. A closure means is attached to the body and extends about the opening for reducing a size of the opening. The sized to cover an upper end of a ladder side rail having a ladder cover thereon or an upper end of a stepladder.

The body is reversible and closure means is attached to the body by a fastening means such as stitching or a hot melt fabric glue. The closure means can be an elastic band.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 2:
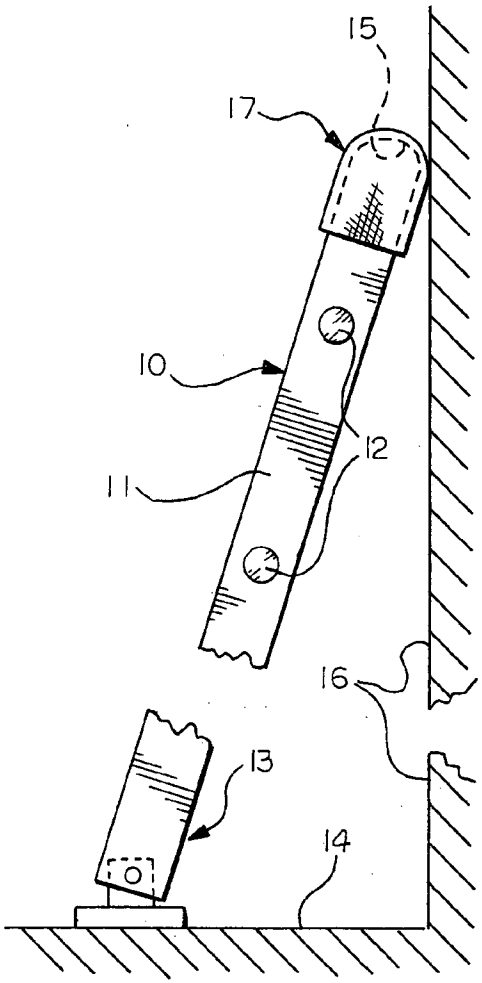
FIG. 2 (PRIOR ART)
FIG. 2 is a fragmentary side elevation view of the ladder shown in FIG. 1.
Figure 1:
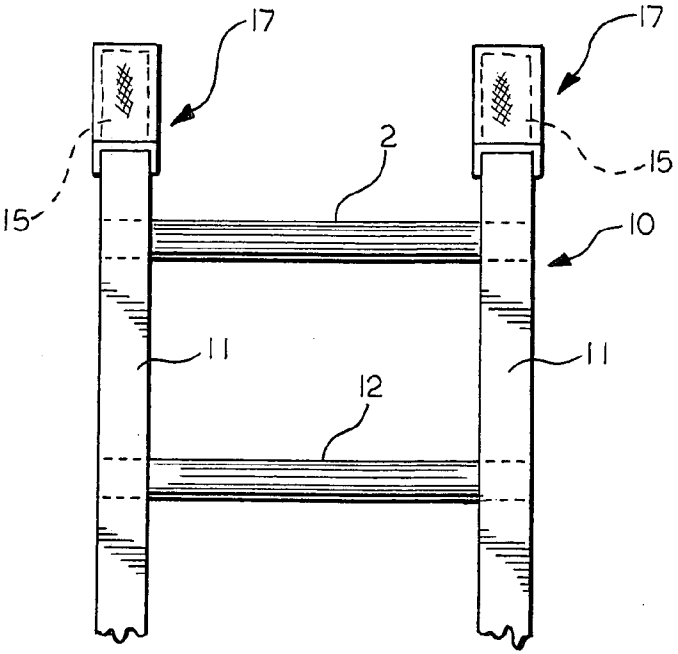
FIG. 1 (PRIOR ART)
FIG. 1 is a fragmentary front elevation view of a typical ladder having a pair of ladder covers installed thereon.

This U.S. provisional patent application Ser. No. 60/437,613 filed Jan. 2, 2003 is incorporated herein by reference. Referring now to FIGS. 1 and 2, there is shown a typical ladder 10 having a pair of spaced apart parallel extending side rails or legs 11 joined at intervals by a plurality of rungs or step members 12. A lower end portion 13 of each the side rails 11 is adapted to engage a generally horizontal support surface 14 such as the ground or the roof of a building. An upper end portion 15 of each of the side rails 11 is adapted to engage a generally vertical surface 16 such as a wall of a building. Thus, as shown in FIG. 2, the ladder 10 is supported by the surface 14 and the surface 16 at an angle to the vertical to permit a painter to climb the rungs 12 and reach the upper portions of the wall 16.

The ladder 10 can be provided with a pair of conventional ladder mitts or covers 17 to minimize damage to the wall 16 such as scratches, nicks and dents that can be produced by the upper ends 15 of the ladder side rails 11. The ladder mitts or covers 17 are commercially available and typically are formed of a plastic foam or rubber-like material with an inverted cup shape to snugly receive the upper end portions 15. However, the ladder mitts or covers 17 can leave marks on freshly painted surfaces and tend to accumulate paint during the painting process, which paint can then be transferred to the wall 16 when the ladder 10 is moved to a new area.

Figure 5:
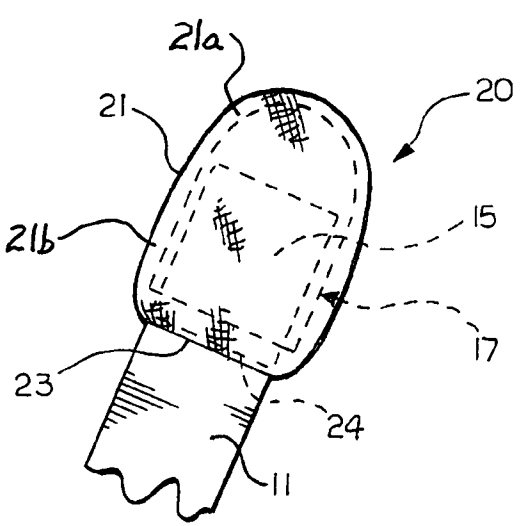
FIG. 5 is a side elevation view of the protective device of FIG. 3 installed on the upper end of the ladder shown in FIGS. 1 and 2.
Figure 3:
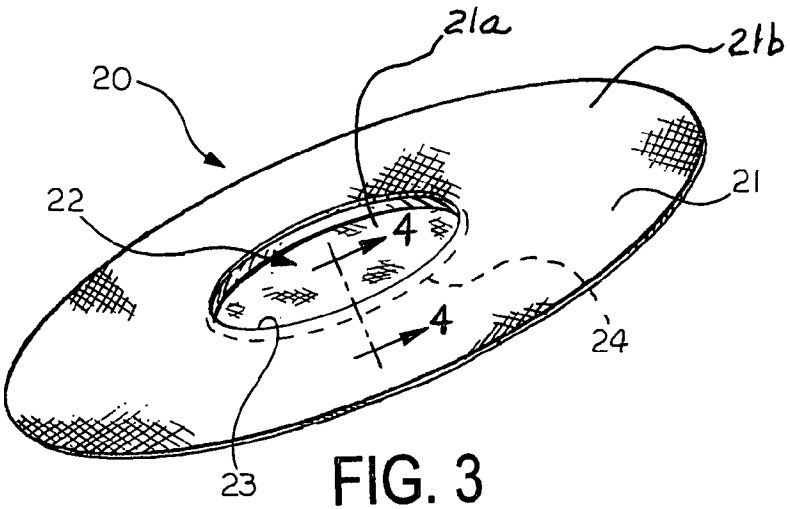
FIG. 3 is a perspective view of a protective device for a ladder in accordance with the present invention.
Figure 4:
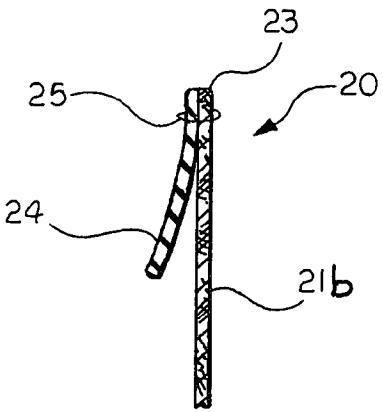
FIG. 4 is an enlarged cross-sectional view of the protective device taken along the line 4—4 in FIG. 3.

A protective device 20 in accordance with the present invention is shown in FIGS. 3 through 5. The protective device 20 includes a flexible body 21 in the shape of a bag with an opening 22 defined by an edge 23. Affixed to an inside surface of the body 21 adjacent to the edge 23 is a closure means 24, such as an elastic band or a drawstring, extending about the opening 22. The closure means 24 tends to close the opening 22 and allow the opening to be increased in size to permit easy installation over one of the covers 17 as shown in FIG. 5. However, the protective device 20 is advantageously reversible such that when paint gets on the outer surface of the body 21, the body can be turned inside out to present the clean inner surface to the outside. Preferably, the body 21 is made of any suitable material, such as a cloth material, preferably terry cloth material.

The protective device 20 in accordance with the present invention can be made in any suitable size and shape. For example, when the body 21 is substantially flat, as shown in FIG. 3, the body 21 can have a diameter of approximately seven to eight inches and the opening 22 can have a diameter of approximately three inches. The protective device 20 having such dimensions will completely enclose a typical one of the coven 17. However, the protective device 20 can be sized for use with a stepladder that has an uppermost or top step that extends across the width of the ladder such that a single one of the protective device 20 fits over the top step. As shown in FIG. 3, the body 21 has a generally circular closed wall 21*a* superposed on and connected to a generally annular wall 21*b*. The generally annular wall 21*b* has the central opening 22 formed therein and the closure means 24 attached thereto.

The closure means 24 can be made of any suitable elastic material that is cut to a predetermined length band from a longer strip prior to assembly of the protective device 20. The band 24 is positioned against an inside surface of the body 21 and attached by any suitable fastening means 25 such as stitching extending through the body 21 and the band 24. The elastic band 24 can extend completely around the opening 22 or any suitable portion thereof. Another suitable fastening means 25 is a hot melt fabric glue or adhesive of the type commonly used to attach two pieces of fabric together.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A protective device for releasably covering an upper end portion of a ladder to prevent the upper end portion of the ladder from marking or transferring paint to a surface upon which the upper end portion of the ladder rests comprising:

a body formed of a flexible material and being substantially flat when not installed on a ladder, said body having a generally circular closed wall superposed on and connected to a generally annular wall, said annular wall forming a central opening and said body being sized to cover an upper end portion of a ladder; and a closure means attached to said annular wall and extending at least partially about said opening, said closure means being operative to selectively reduce a size of said opening to releasably retain said body on the upper end portion of the ladder whereby when said body is installed on the upper end portion of the ladder, said body prevents the upper end portion of the ladder from marking or transferring paint to a surface upon which the upper end portion of the ladder rests.

2. The protective device according to claim 1 wherein said body is formed of a sheet of fabric material.

3. The protective device according to claim 1 wherein said body is formed of a terry cloth material.

4. The protective device according to claim 1 wherein said body is sized to cover an upper end of a ladder side rail.

5. The protective device according to claim 4 wherein said body is sized to cover an upper end of a ladder side rail having a ladder cover thereon.

6. The protective device according to claim 1 wherein said body is sized to cover an upper end of a step ladder.

7. The protective device according to claim 1 wherein said body is reversible being adapted to be turned inside out to present an inner surface of said body as an outer surface when installed on the upper end portion of the ladder.

8. The protective device according to claim 1 wherein said closure means is attached to said body by a fastening means.

9. The protective device according to claim 8 wherein said fastening means is stitching.

10. The protective device according to claim 8 wherein said fastening means is a hot melt fabric glue.

11. The protective device according to claim 1 wherein said closure means is an elastic band.

12. A protective device for releasably covering an upper end portion of a ladder comprising:

a body formed of a sheet of clot material and being substantially flat when not installed on a ladder, said body having a generally circular closed wall superposed on a generally annular wall, said annular wall forming a central opening, said body being sized to cover an upper end portion of a ladder, said body being reversible for turning inside out to present an inner surface of said body as an outer surface when installed on the upper end portion of the ladder; and a closure means attached to said annular wall and extending about said opening, said closure means being operative to selectively reduce a size of said opening to releasably retain said body on the upper end portion of the ladder whereby when said body is installed on the upper end portion of the ladder, said body prevents the upper end portion of the ladder from marking or transferring paint to a surface upon which the upper end portion of the ladder rests.

13. A protective device comprising:

a body formed of a flexible material and being substantially flat when not installed, said body having a generally circular closed wall superposed on and connected to a generally annular wall, said annular wall forming a central opening;

an elastic band extending at least partially about said opening, said elastic band being operative to selectively reduce a size of said opening to releasably retain said body on an end of an object; and a fastening means attaching said elastic band to said body at an edge of said annular wall surrounding said opening.

14. The protective device according to claim 13 wherein said body is reversible being adapted to be turned inside out to present an inner surface of said body as an outer surface when installed on the upper end portion of the ladder.

15. The protective device according to claim 13 wherein said fastening means is stitching.

* * * * *